US005220338A

United States Patent [19]

Matsushita

[11] Patent Number: 5,220,338

[45] Date of Patent: Jun. 15, 1993

[54] ANTENNA ELEMENT

[75] Inventor: Atsushi Matsushita, Fukuishi, Japan

[73] Assignee: Creatic Japan, Inc., Fukui, Japan

[21] Appl. No.: 778,823

[22] PCT Filed: Apr. 23, 1991

[86] PCT No.: PCT/JP91/00543

§ 371 Date: Dec. 19, 1991

§ 102(e) Date: Dec. 19, 1991

[87] PCT Pub. No.: WO91/17584

PCT Pub. Date: Nov. 14, 1991

[30] Foreign Application Priority Data

Apr. 27, 1990 [JP] Japan ..... 2-110355

[51] Int. Cl.[5] ..... H01Q 7/08

[52] U.S. Cl. ..... 343/787; 343/788; 343/895

[58] Field of Search ..... 343/795, 787, 788, 742, 343/866, 749

[56] References Cited

U.S. PATENT DOCUMENTS

| | | | |
|---|---|---|---|
| 2,748,386 | 5/1956 | Polydoroff | 343/787 |
| 4,205,318 | 5/1980 | Pisano | 343/741 |
| 4,375,642 | 3/1983 | Dörrie et al. | 343/895 |
| 4,442,438 | 4/1984 | Siwiak | 343/792 |
| 4,458,248 | 7/1984 | Lyasko | 343/895 |
| 5,065,138 | 11/1991 | Lian et al. | 343/895 |
| 5,081,469 | 1/1992 | Bones | 343/895 |

*Primary Examiner*—Michael C. Wimer
*Assistant Examiner*—Tan Ho
*Attorney, Agent, or Firm*—Bucknam & Archer

[57] ABSTRACT

An antenna element comprising a hollow pipe made of a magnetic material said hollow pipe having an axial bore extending therethrough; a solid or hollow metal bar made of at least one metal selected from the group consisting of aluminum, titanium, copper and alloys thereof, said metal bar being inserted into the axial bore; an insulating material existing between the hollow pipe and the metal bar; and an electrically conductive wire being wound on at least a part of an outer surface of the hollow pipe, said electrically conductive wire having been coated with an insulating material.

14 Claims, 2 Drawing Sheets

FIG. 1

ANTENNA ELEMENT

TECHNICAL FIELD

This invention relates to antenna elements, and, more specifically, it relates to an antenna element comprising a core which comprises a hollow pipe made of a magnetic material and a metal bar made of aluminum, titanium, copper, or an alloy of those metals, and a wire of electrically conductive material which is wound on a surface of the core.

BACKGROUND ART

Recent development and popularization of a portable TV, such as car TV and handy TV, equipment for satellite communication, movable telephone, etc. requires smaller and lighter antennas with high performance than traditional Yagi Antennas for VHF/UHF and parabola antennas for micro waves, considering convenience for users and outlook.

Additionally, each unit of traditional antennas suites to a limited range of wave length, so that two antennas are necessary to receive VHF and UHF waves for TV, where very careful adjustments of the length of antenna elements is very essential. This leads to complication and high costs of receiving units. An example has been taken for car TV, where a combination of a dipole antenna or whip antenna and a diversity circuit has been developed and commercially available. This type of antenna is, however, very sensitive to reflection noises from buildings, etc. and the performance to receive UHF wave is not satisfactory.

Further, plane antennas or print antennas for receiving satellite broadcasting and/or for mobility communication, that offer smaller size than the parabola antenna, have been commercially available. Such antennas also have the limitation of maintaining the performance.

An improvement was proposed to use a ferrite core with electrically conductive coil, that has the disadvantage of strong directivity and narrow range of receivable wave length to be used leading to limitation of application to radio but not to TV.

The object of this invention is to provide a small sized and light antenna element which has high fidelity and less directivity, and is suitable with wide range wave length.

DISCLOSURE OF INVENTION

The present inventor made intensive studies in an attempt to achieve the object in view of the above problems of the prior art and, as the result of his studies, he found that an antenna element comprising a core which comprises a hollow pipe made of a magnetic material, a metal bar made of aluminum, titanium, copper or an alloy thereof and being inserted into the hollow pipe, and an insulating material located between the hollow pipe and the metal bar; and an electrically conductive wire which is wound on a surface of the core can achieve the above object. This invention is based on the above finding.

The antenna element of the present invention is characterized in that it comprises a hollow pipe made of a magnetic material said hollow pipe having an axial bore extending therethrough; a solid or hollow metal bar made of at least one metal selected from the group consisting of aluminum, titanium, copper and alloys thereof, said metal bar being inserted into the axial bore; an insulating material located between the hollow pipe and the metal bar; and an electrically conductive wire being wound on at least a part of an outer surface of the hollow pipe, said electrically conductive wire having been coated with an insulating material.

The magnetic materials to be used for this invention are preferably those with high magnetic permeability, with less sensitivity to the frequency of electromagnetic wave, with high saturation magnetic flux density, with less coercive force, and with magnetostriction, and more preferably having a maximum magnetic permeability of about 100,000 $\mu_{max}$ or more, and most preferably about 500,000 $\mu_{max}$ or more. Using the magnetic materials with higher permeability and less sensitivity to frequency, the performance of the antenna tends to be improved.

Various kinds of magnetic materials can be used for this invention but amorphous metals are preferable due to its high strength, hardness and anti-corrosion property in addition to above general magnetic properties, that lead to high performance of the antenna element. Amorphous metals to be used for this invention are preferably iron-based or cobalt-based amorphous metals, and more preferably amorphous metals of Co-Fe-Ni-B-Si type, Co-Fe-Ni-Mo-B-Si type, Co-Fe-Si-B type, Fe-B-Si type, and Fe-Ni-Mo-B type.

General magnetic characteristics of iron-based or cobalt-based amorphous metals are as follows:

| | |
|---|---|
| Maximum permeability: | $\mu_{max}$: 10,000–1,000,000 |
| Saturation magnetic flux density: | $B_s$(KG): 5.5–18.0 |
| Coercive force: | $H_c$(Oe): 0.003–0.4 |
| Residual magnetic flux density: | $B_r$(KG): 2.8–16.0 |
| Initial magnetic permeability: | $\mu_i$ at B = 0.002T: 2,000–15,000 |
| Magnetostriction: | $\lambda_s \times 10^{-5}$: −40 |
| Curie point: | $T_c$(degree C.): 205–415 |

and those are preferable for this invention.

This invention may use any of amorphous metals made by liquid phase method such as liquid quenching, gas phase method such as spattering, or plating method.

The shape of the magnetic material is not specially designed but to be a hollow pipe shape having an axial bore in which a metal bar described later is inserted. The structure of the hollow pipe made of the magnetic material is also flexible. The hollow pipe may be a simple body, and, in a case where a magnetic material, such as an amorphous metal, being difficult of shaping to a hollow pipe in a simple body is used, the hollow pipe may preferably consist of multiple fibers, bars or strips of a magnetic material, or may be preferably formed by rolling a sheet-shaped magnetic material.

Further, in the case in which a magnetic material, such as an amorphous metal, having high retention of shape is used, it is most preferable that the hollow pipe made of the magnetic material be formed by rolling an insulating film, such as polyester film, on which the multiple numbers of fiber-, bar-or strip-shaped magnetic materials have been laid in parallel, since the hollow pipe can be easily produced by the method.

The diameter of a fiber-or bar-shaped magnetic material is preferably 500 μm or less, and most preferably 25 μm or less. Further the thickness of a fine plate- or sheet-shaped magnetic material is preferably 500 μm or less, and most preferably 25 μm or less. Smaller sized magnetic material leads to less sensitivity of permeability to frequency.

The material of the metal bar to be inserted in above pipe is at least one metal selected from the group of aluminum, titanium, copper and alloys thereof. An aluminum bar preferably achieves less weight and less cost. The bar should be inserted into the hollow pipe, and an insulation material should be located between the pipe and the bar.

The diameter of the bar is preferred to be approximately close to inner diameter of the pipe. The bar can be solid or hollow, and a metal pipe, especially aluminum pipe is recommended to minimize antenna element weight.

Preference of dimensions of the hollow pipe and the metal bar used for the present invention are chosen to fit to frequency of waves to be received. For instance, an antenna element of the present invention for VHF and UHF prefers the length of metal bar of 10–2,000 mm, most preferably 200–500 mm, and that of hollow pipe of longer than 10 mm and shorter than the bar length, most preferably 50–200 mm. An antenna element having the total length of longer than 2,000 mm achieves high performance for low frequency waves but has strong directivity. An antenna element using a hollow pipe of shorter than 10 mm or a metal bar of shorter than 10 mm does not show the advantages of this invention.

A core of the antenna element of the present invention comprises the hollow pipe made of a magnetic material, the metal bar being inserted into said hollow pipe, and an insulating material located between the hollow pipe and the metal bar to insulate said metal bar from said hollow pipe.

The insulation material to be used between the hollow pipe and the metal bar does not need any specific requirements, but insulating films of organic high molecular compounds or metal oxides are preferred.

It was found that a better performance is achieved if one edge of the hollow pipe is located at the same level of the corresponding edge of the metal bar in it.

In the present invention, an electrically conductive wire is wound on at least a part of an outer surface of the hollow pipe. The electrically conductive wire can be a conventional one such as aluminum or copper wire coated with a synthetic resin. The direction of winding can be clock- or anticlock-wise but shall be one direction throughout the length. It is preferably suggested to wind the wire throughout the hollow pipe length without gaps in between. It is possible to wind the wire as multiple layer, and a printed sheet circuit can also be utilized replacing wire.

At least one end of the electrically conductive wire of the antenna element of the present invention is connected to a receiving unit. It is preferably suggested to connect one end of the wire to the receiving unit, not connecting both ends to decrease noise level. The connecting end is recommended to be the lead wire from the antenna end, where the positions of the hollow pipe and the inserted bar are at the same level.

The antenna element of the present invention can be used as single one, but can also be combined with multiple units of the invented ones or with conventional ones.

The accessories for convenient usage of the antenna elements of the present invention may be selected, for instance an adopter for easy setting to cars, rubber magnet to use as flat antenna.

BEST MODE FOR CARRYING OUT THE INVENTION

This invention will be explained hereinunder referring to examples and Comparative Examples in more detail.

EXAMPLE 1

This invention will be explained referring to FIGS. 1–4.

Figure 1:
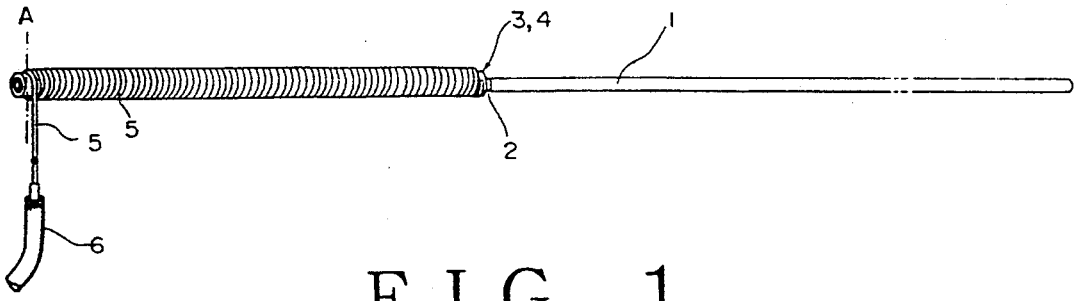
FIG. 1 is a side view showing the antenna element manufactured in Example 1.
Figure 2:
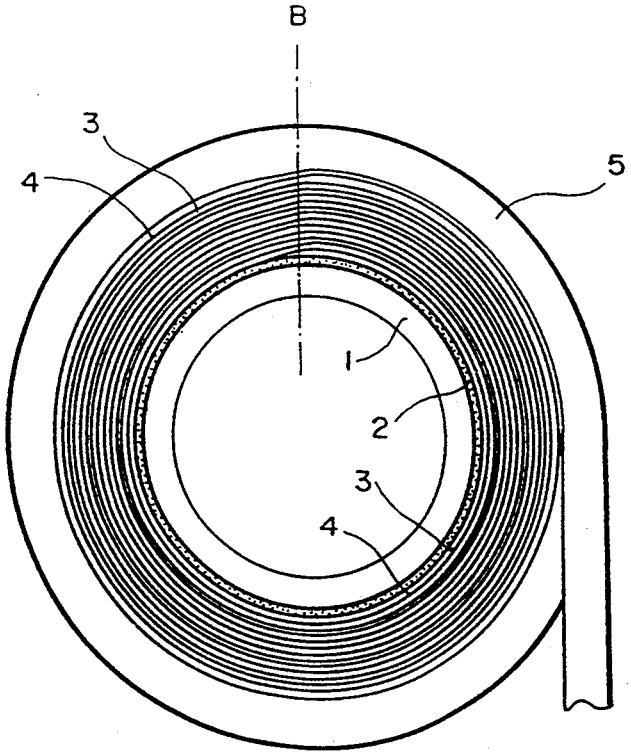
FIG. 2 is a cross sectional view showing section A of the antenna element shown in FIG. 1.
Figure 3:
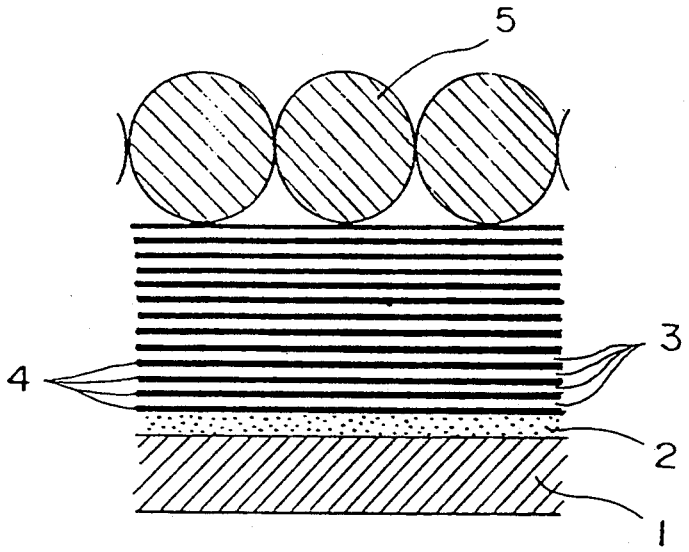
FIG. 3 is a partial cross sectional view showing section B of the antenna element shown in FIG. 2.
Figure 4:
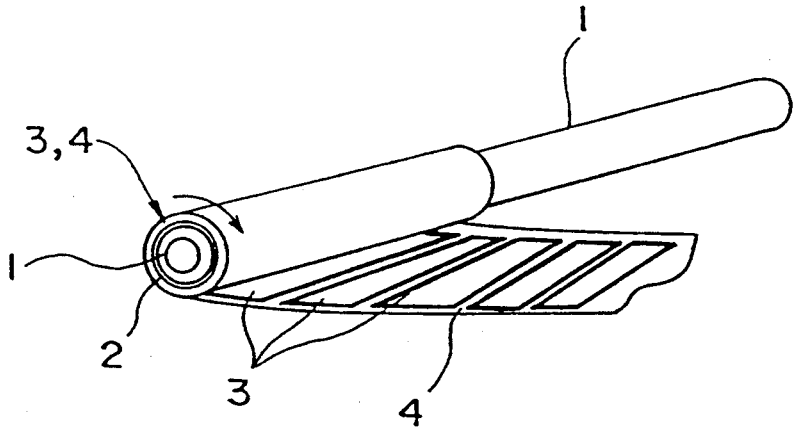
FIG. 4 is a perspective view showing a manufacturing process of the antenna element shown in FIG. 1.

FIG. 1 is a side view showing the antenna element manufactured in Example 1, FIG. 2 is a cross sectional view showing section A of the antenna element shown in FIG. 1, FIG. 3 is a partial cross sectional view showing section B of the antenna element shown in FIG. 2, and FIG. 4 is a perspective view showing a manufacturing process of the antenna element shown in FIG. 1.

In FIGS. 1 to 4, numbers given in the Figures mean: 1: Aluminum pipe, 2: Insulation tube, 3: Amorphous metal, 4: Polyester film, 5: Aluminum wire, 6: Coaxial lead wire.

In this Example, an aluminum pipe 1 sized by 6 mm outside diameter, 5 mm inner diameter and 450 mm length was used, an outer surface of which was covered by a commercially available insulation tube 2 (a shrinkable tube made of a synthetic resin) in the width of 200 mm from one edge of pipe 1.

Twenty five (25) pieces of amorphous metal strips 3 sized by 200 mm length, 10 mm width and 25 μm thickness (made by Allied Inc., USA, Metoglass 2714 A) were laid in parallel on a polyester film 4 (two sheets of 300–400 mm length, 200 mm width and 13 μm thickness). The insulation tube 2 was wrapped by this sheet 4, as shown in FIG. 4, forming a hollow pipe shaped body made of amorphous metal 3 (hereinafter referred to as "amorphous metal hollow pipe"). The properties of the amorphous metal used are;

| (Compositions) Co—Fe—Ni—B—Si type (Magnetic properties) | |
|---|---|
| Maximum permeability | $\mu_{max}$: 1,000,000 |
| Saturation magnetic flux density | $B_s$(KG): 5.5 |
| Magnetostriction | $\lambda_s \times 10^{-6}$: <1 |
| Curie point | Tc(deg C.): 205 |

An aluminum wire 5 (1 mm diameter, coated by a synthetic resin insulation material on the surface) was wound on the amorphous metal hollow pipe 3, throughout the length (200 mm total length) from one end to the other, and without gap in between to obtain an antenna element of the present invention.

One end of the aluminum wire 5 (connected to the end where edges of aluminum pipe 1 and the amorphous metal hollow pipe 3 are at the same level) was connected to a signal level meter (LEADER Signal Level Meter LFC-945, manufactured by Leader Electronic, Inc.) via central electric conductor of coaxial cable 6

(manufactured by Fujikura Co., 2.5C-2V, 4 m length). Further, another end of the aluminum wire 5 was kept open.

This antenna element was set in a timber house (3-2-27, Daiganji, Fukui-shi, Fukui-ken, Japan) located at approx. 4 km far from a broad casting antenna of a TV station, where no obstacles exist. The received signal level of TV set with wave specifications are listed in Table 1, where three cases of antenna axis direction, vertical position (V), horizontally directed to broad casting antenna ($H_0$), and turned by 90 degree ($H_{90}$), were compared.

Further, a micro TV with a liquid crystal display (manufactured by Matsushita Electric Industries, Co., Ltd., Japan, TR-3LT4, 75Ωconnecting terminal) was connected to the antenna element instead of the signal level meter. Receiving performance of TV broadcastings was inspected, and the results are shown in Table 1.

EXAMPLE 2

In this Example an aluminum pipe sized by 6 mm outside diameter, 5 mm inner diameter, and 350 mm length was used, on which an insulating coating of aluminum oxide ($Al_2O_3$) was formed in the length of 110 mm from one end of the pipe.

The insulating-coated surface of this aluminum pipe was wrapped by an amorphous metal sheet (manufactured by Allied Inc., USA, Metoglass 2714 A) sized by 100 mm length, 50 mm width and 25 μm thickness, and further wound by a copper wire (1 mm diameter, coated by insulation synthetic resin) as the same manner as Example 1 to obtain an antenna element of the present invention.

The antenna element was tested as the same manner as for Example 1. The results are listed in Table 1.

COMPARATIVE EXAMPLE 1

The aluminum pipe used in Example 1 was only used as the antenna element in this case. That is, the coaxial conductive wire used in Example 1 was connected to one end of the aluminum pipe directly, and the same tests were carried out. The results are shown in Table 1.

COMPARATIVE EXAMPLE 2

A conventional TV antenna for automobiles (manufactured by Clarion, Inc., ZCA-301, two rod antenna elements sized by 2 mm diameter and 400 mm length) was used for this Comparative Example. Test conditions and procedures were the same as those for Example 1, and the results are also listed in Table 1.

TABLE 1

| Example Comp. Ex. | Antenna direction | Signal level (dB) *1 Ch. 3 *3 | Ch. 9 *4 | Ch. 11 * | Ch. 39 *6 | TV receiving performance *2 Ch. 3 *3 | Ch. 9 *4 | Ch. 11 * | Ch. 39 *6 |
|---|---|---|---|---|---|---|---|---|---|
| Example | V | 58 | 57.5 | 64 | 54.5 | A | A | A | A |
| 1 | $H_0$ | 56 | 60 | 63 | 53 | A | A | A | A-B |
| | $H_{90}$ | 62 | 62 | 60 | 51 | A | A | A | B |
| Example | V | 59 | 56 | 63 | 54 | A | A | A | A |
| 2 | $H_0$ | 60 | 58 | 60 | 54 | A | A | A | A |
| | $H_{90}$ | 60 | 63 | 64 | 55 | A | A | A | A |
| Comp. Ex. | V | 53 | 53 | 45 | 50.5 | B | B | C | B |
| 1 | $H_0$ | 53 | 61 | 64 | 50 | B | A | A | B |
| | $H_{90}$ | 53 | 60 | 64 | 44 | B | A | A | C |
| Comp. Ex. | V | 62 | 62 | 59 | 44 | A | A | A | C |
| 2 | $H_0$ | 41 | 57 | 57 | 49 | C | A | A | C |
| | $H_{90}$ | 53 | 65 | 62 | 42 | B | A | A | C |

*1 Measured value is the received signal level for picture signal.
*2 A: Both picture and sound are excellent.
B: Sound is excellent with some disturbance in picture.
C: Both picture and sound have some disturbance.

| | Name | (Range) | Picture (MHz) | Sound (MHz |
|---|---|---|---|---|
| *3 Channel 3 | NHK Education | VHF | 103.25 | 107.75 |
| *4 Channel 9 | NHK General | VHF | 199.24 | 203.74 |
| *5 Channel 11 | Fukui Broad Casting (FBC) | VHF | 211.24 | 215.74 |
| *6 Channel 39 | Fukui Television(FTB) | UHF | 627.24 | 631.74 |

As is apparent from the results shown in Table 1, the antenna element using only a single aluminum pipe (Comparative Example 1) can only be adopted to channels 9 and 11.

The conventional antenna for automobiles (Comparative Example 2) shows sharp the receiving level for UHF range is not sufficient. It was not possible to improve the performance even adjusting positions of two antenna elements.

On the contrary, the antenna elements of the present invention had high sensitivity for wide range from VHF to UHF waves. Further, the antenna elements of the present invention had very week directivity, and therefore, they enabled to receive the waves excellently regardless of direction of the antenna elements. By using of the antenna elements of the present invention, the images on TV screen and voices were received excellently for all of the channels.

INDUSTRIAL APPLICABILITY

As is clear from the above description, the antenna elements of the present invention are characterized with small size, less weight, and high sensitivity with less directivity for wide range of wave frequency. Therefore, each of those antenna elements enables to receive VHF and UHF waves excellently with single antenna element.

It is recommended to use the antenna elements of the present invention for TV units, especially for automobile TV, handy TV, etc. which are not settled at a fixed position.

I claim:

1. An antenna element to receive signals of VHF and UHF comprising a hollow pipe made of an amorphous magnetic metal, said hollow pipe having an axial bore extending therethrough; a metal bar made of at least one metal selected from the group consisting of aluminum, titanium, copper and alloys thereof, said metal bar being inserted into the axial bore, an insulating material located between the hollow pipe and the metal bar, and an electrically conductive wire being wound on at least a part of an outer surface of the hollow pipe, said electrically conductive wire having been coated with an insulating material prior to winding.

2. An antenna element according to claim 1, wherein the hollow pipe is formed from a sheet shaped amorphous metal.

3. An antenna element according to claim 1, wherein the hollow pipe is formed by multiple numbers selected from the group consisting of fiber-, bar- or strip-shaped materials.

4. An antenna element according to claim 3, wherein the hollow pipe is formed by rolling an insulating film on which the multiple numbers of fiber-, bar- or strip-shaped amorphous materials have been laid in parallel.

5. An antenna element according to claim 1, wherein the amorphous metal has a property of maximum magnetic permeability of greater than 100,000 $\mu_{max}$.

6. An antenna element according to claim 1, wherein the metal bar is sized by 10 to 2,000 mm in length, and the hollow pipe is not shorter than 10 mm and not longer than the metal bar.

7. An antenna element according to claim 1, wherein the metal bar is sized 200 to 500 mm in length, and the hollow pipe is sized 50 to 200 mm in length.

8. An antenna element according to claim 1, wherein the metal bar is an aluminum bar.

9. An antenna element according to claim 1, wherein the insulating material located between the hollow pipe and the metal bar is an insulating film made of a member selected from the group consisting of organic polymer compounds and metal oxides.

10. An antenna element according to claim 1, wherein one end of the electrically conductive wire is connected with a receiving unit and another end is kept open.

11. An antenna element according to claim 1, wherein one edge of the hollow pipe and the corresponding edge of the metal bar are at the same level.

12. An antenna element according to claim 11, wherein one end of the electrically conductive wire corresponding to said edge of said hollow pipe and said edge of said metal bar which are at the same level is connected with a receiving unit and another end of said wire is kept open.

13. An antenna element according to claim 1, wherein the metal bar is a solid one.

14. An antenna element according to claim 1, wherein the metal bar is a hollow one.

* * * * *